US008347666B2

(12) United States Patent
Stendal

(10) Patent No.: US 8,347,666 B2
(45) Date of Patent: Jan. 8, 2013

(54) LOCKING DEVICE, A LOCKING ARRANGEMENT, AND A LOCKING SYSTEM

(75) Inventor: Jan Stendal, Västerås (SE)

(73) Assignee: Stendals el Aktiebolag, Västerås (SE)

( * ) Notice: Subject to any disclaimer, the term of this patent is extended or adjusted under 35 U.S.C. 154(b) by 0 days.

(21) Appl. No.: 12/311,087

(22) PCT Filed: Sep. 18, 2007

(86) PCT No.: PCT/SE2007/050659

§ 371 (c)(1),
(2), (4) Date: Mar. 18, 2009

(87) PCT Pub. No.: WO2008/036037

PCT Pub. Date: Mar. 27, 2008

(65) Prior Publication Data

US 2010/0043506 A1 Feb. 25, 2010

(30) Foreign Application Priority Data

Sep. 19, 2006 (SE) ..... 0601951

(51) Int. Cl.
*E05B 65/08* (2006.01)

(52) U.S. Cl. ..... 70/99; 70/100; 70/DIG. 11; 160/201; 292/DIG. 36

(58) Field of Classification Search ..... 70/95, 99, 70/100, DIG. 11, 96–98; 292/DIG. 36, DIG. 46; 160/201
See application file for complete search history.

(56) References Cited

U.S. PATENT DOCUMENTS

| | | | | |
|---|---|---|---|---|
| 1,908,165 | A * | 5/1933 | Moler | 160/113 |
| 2,827,114 | A * | 3/1958 | Stroup | 160/209 |
| 3,426,829 | A * | 2/1969 | McDaniel et al. | 160/201 |
| 3,933,382 | A | 1/1976 | Counts et al. | |
| 4,345,448 | A * | 8/1982 | Solomon | 70/95 |
| 4,565,078 | A * | 1/1986 | Solomon | 70/95 |
| 4,570,467 | A * | 2/1986 | Greco | 70/99 |
| 4,782,674 | A * | 11/1988 | Johnson | 70/95 |
| 5,533,561 | A | 7/1996 | Forehand, IV | |
| 5,572,829 | A * | 11/1996 | Stoltenberg | 49/200 |
| 5,601,131 | A | 2/1997 | Morris | |
| 6,463,989 | B1 * | 10/2002 | Johnson | 160/201 |
| 8,016,015 | B2 * | 9/2011 | Chamberlain et al. | 160/201 |
| 2004/0108742 | A1 | 6/2004 | Pringnitz | |
| 2007/0181268 | A1 * | 8/2007 | Chamberlain et al. | 160/201 |

FOREIGN PATENT DOCUMENTS

| | | |
|---|---|---|
| DE | 19921082 | 11/2000 |
| EP | 0924371 | 6/1999 |

* cited by examiner

*Primary Examiner* — Lloyd Gall

(74) *Attorney, Agent, or Firm* — Dilworth & Barrese, LLP

(57) ABSTRACT

The invention relates to a locking device adapted for locking a shutter element (13) adapted to slide along a railing (11), which locking device (3) comprises at least one locking bolt (5) movable between a first state, in which the locking bolt is adapted to engage with a locking member (9) in the shutter element to lock the shutter element against movement, and a second state, in which the locking bolt is adapted to avoid engagement with the locking member and to allow movement of the shutter element. The invention also relates to a locking arrangement adapted to be connected with and allow locking of a shutter element (13) arranged to slide along a railing (11), which locking arrangement (7) comprises at least one locking member (9) shaped to allow a locking bolt (5) to, in a first state, engage with and lock the locking member, and thus the shutter element, against movement. The invention also relates to a locking system.

9 Claims, 2 Drawing Sheets

LOCKING DEVICE, A LOCKING ARRANGEMENT, AND A LOCKING SYSTEM

BACKGROUND OF THE INVENTION

1. Technical Field

Figure 1A:
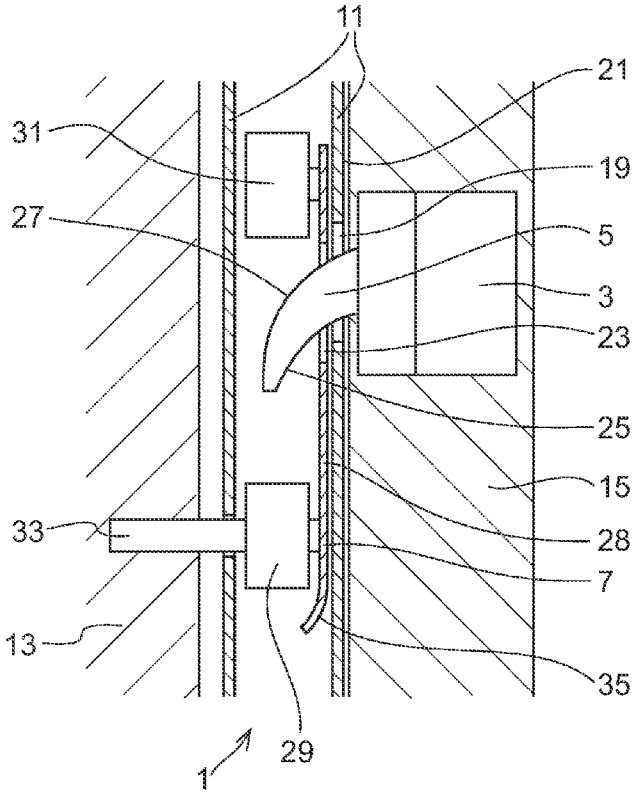

The present invention relates to a locking device adapted for locking a shutter element arranged to slide along a railing. It further relates to a locking arrangement, which is connected with a shutter element and which is adapted to allow locking of the shutter element. It further relates to a locking system.

2. Prior Art

It is known with shutter elements arranged to slide in railings, for example hatches, doors, such as garage doors, or windows, which needs to be locked in order to avoid entrance by undesired individuals.

When locking such shutter elements it is known to arrange locks in the form of long, displaceable rods extending across the back of the shutter element, and which engage with a securing plate arranged in the floor/ceiling or in the wall to the side of the shutter element. Such locks suffer the disadvantage that they are fragile due to the long rods, which are easily bent when strained.

It is also known to arrange locks arranged along a wall and engaging a securing plate arranged in the shutter element. Such locks have better durability but suffer the disadvantage that it is difficult to make room for the locks along the wall. Close to the wall the space is partly occupied by the railing in which the shutter element slides, and partly by springs, cords or wires, which handle the displacement of the shutter element.

This problem has previously been solved by providing the shutter element with a securing plate projecting perpendicularly and backwardly from the shutter element and by placing the lock with the locking bolt to one side of the railing. Thus there is room for the lock but it gives the disadvantage that the crushing risk increases and that the lock can more easily be damaged since the lock protrudes outwardly a good distance behind the shutter element.

SUMMARY OF THE INVENTION

One object with the invention is to indicate an improved manner of locking shutter elements arranged to slide along the railing.

This object is achieved with a locking device according to the description herein and which is by the locking bolt being shaped to, in the first state, project into the railing for engagement with the locking member inside the railing. This object is also achieved by a locking arrangement according to the description herein, and which is characterized by the locking member being adapted to slide inside the railing. This object is also achieved by a locking system according to the description herein.

By the locking bolt engaging with a locking member sliding inside the railing the locking device may be positioned in connection with the railing, which previously had not been possible, so that a previously unexploited space may be used for containing the locking device. Thus the locking device may be positioned in a better, more space saving and more purposeful manner. The locking device may further be positioned so that the locking device neither disturbs, or is hindered by, the cords, wires or springs controlling the displacement of the shutter element. Furthermore the locking device may be placed so that it is protected, so that partly the crushing risk for users is decreased, and partly so that the risk of damage on the locking device itself is decreased.

The locking device according to the invention is preferably shaped so that the locking bolt projects from the locking device in the first state and so that the locking bolt is retracted inside the locking device in the second state. Of course this does not prevent the locking bolt from being projected into the railing in the first state, since the greater part of the locking device preferably is placed on the outside of the railing. Preferably the locking device also comprises other components common in locks, such as a locking mechanism for locking the bolt in the first, projected state and so on. With advantage a locking device may be an electrical lock and/or a lock, which is remote controlled.

According to one embodiment the locking device is shaped for being positioned behind the railing, wherein the bolt is shaped to project into the railing through a hole in the backside of the railing. Thus the locking device does not need to be arranged at the side of the railing, which saves space and also makes that the locking device does not protrude out from the back of the shutter element with an ensuing crushing and damaging risk. With advantage the locking device is adapted to be positioned inside an attachment element adapted to connect the railing with a wall element, for example a solid wall. Hence the locking device may be positioned inside the wall, wherein the wall element protects and houses the locking device.

According to one embodiment the locking bolt comprises an engagement surface adapted to engage and lock the movement of the locking member, which engagement surface is angled so that the locking member is pressed towards a fixed side of the railing, and/or the locking device, when the locking member is pressed against the locking bolt. Preferably the engagement surface is concave. More preferably the engagement surface is continually curved. Thus the locking member, for example a shutter plate, is pressed towards a fixed side, so that the friction between the fixed side and the locking member increases. Hence it is more difficult to break the lock, since a part of the force pressing against the bolt will be transferred perpendicularly into the fixed side.

According to a further embodiment the locking bolt comprises an outside being angled so that the bolt is pressed towards the second state when the locking member is pressed against the outside. Thus the locking member may easily pass the locking bolt when closing the shutter element and locking member. With advantage the outside of the bolt is convex. With advantage the outside is also continuously curved. Thus a soft pressing of the bolt towards the second state is provided.

According to a further embodiment the locking member comprises a wheel adapted to slide inside the railing. It is known to let the shutter element comprise wheels sliding inside the railing in order to decrease the friction. By letting the locking member comprise such a wheel it is achieved partly that the locking member easily slides inside the railing, and partly that the construction of the shutter element does not need to change due to the locking member, and that known components may be used for the shutter element. Thus the cost for the locking member is decreased.

According to one embodiment the locking member is rotatably connected with the shutter element. The locking member is preferably elongated and arranged to slide along the railing in the length direction. Furthermore, such railings usually comprise at least one curved portion, wherein an elongated locking member may become stuck in the curved portion. By shaping the locking member to rotate the risk that the locking member gets stuck in the railing decreases and it also decreases the friction when the locking member slides along the railing.

Preferably the locking member also comprises a second wheel adapted to slide along the railing. Preferably the wheels are arranged in each end of an elongated locking member. Thus the stability of the locking member increases. The locking member is thus shaped as a sleigh sliding inside and following the railing. Preferably, the locking member is also connected with the shutter element by a wheel axle. Thus it is simple to shape the locking member to rotate. Preferably the wheel axle is shaped rotatable in relation to the shutter element. Alternatively the locking member may be rotatable in relation to the wheel axle.

According to one embodiment the locking member comprises a shutter plate adapted to engagingly cooperate with the locking bolt. Preferably the shutter plate comprises a plate adapted to slide in the railing. Preferably the locking member comprises a hole adapted to allow passage of the locking bolt through the hole for engagement with the locking member. Thus an efficient way of forming the engagement between the locking bolt and the locking member is achieved.

According to one embodiment the locking plate comprises an angled edge adapted to, be pressed towards the outside of the locking bolt, preferably when closing the shutter element, in order to press the bolt towards the second state. Thus the passage of the locking member over the locking bolt is facilitated, for example when closing the shutter element. Preferably the angled edge is thus angled in relation to a direction in parallel with the length of the railing.

According to one aspect of the invention the locking system comprises a railing adapted to control a shutter element arranged to slide along the railing. Preferably the railing is adapted to allow a locking member according to the above to slide inside the railing. Preferably the railing is also adapted for connection of a locking device according to the above, for locking the movement of the locking member along the railing.

According to one embodiment the railing is provided with a hole adapted to allow passage of the locking bolt. Preferably the hole is adapted to allow passage of the locking bolt from outside the railing to the inside of the railing. Preferably the hole is adapted in the back of the railing, which is attached against for example an attachment element or a wall, wherein the locking device with advantage is arranged behind the railing. Thus the locking device may be hidden behind the railing so that the locking device is protected.

According to one embodiment the locking device is shaped to be positioned close to the end of the railing. Preferably the railing and locking member respectively are adapted for locking the shutter element close to the end of the railing, in a direction towards closing of the locking element. Thus the locking system does not disturb the displacement of the shutter element other than at the end or the beginning of a closing or opening movement.

According to one embodiment the railing is a guiding-rail. A guiding-rail comprises a back, two sidewalls, and a front provided with a groove allowing connection between the locking member that slides in the railing, and the shutter element arranged outside the railing. By the guiding-rail enclosing the locking member that slides inside the railing from all directions it is ensured that the locking member safely remains inside the railing. Furthermore, a guiding-rail is a standard component, which may be procured at a low cost.

According to a preferred embodiment the shutter element is substantially flat, wherein the thickness of the shutter element is substantially smaller than the length and width of the shutter element. Preferably, the shutter element is arranged to cover an opening into a building. Preferably, the shutter element is a hatch, a gate, a window or a door. According to a preferred embodiment the locking system comprises a shutter element in the form of a garage door. The locking system according to the invention is especially suitable for use with garage doors, which are often displaced upwards towards the ceiling of the garage in order to save space. Thus the locking system comprises a railing comprising a curved portion, which sets high demands on the locking system and make a traditional positioning of the locking device more difficult. Preferably the railing is placed indoors in connection with the outer wall of the building. Preferably the railing is placed directly inside the outer wall in connection with the opening. With advantage the locking device comprises a locking bolt, which is mechanically operable with a locking cylinder that can be turned with a key.

SHORT DESCRIPTION OF THE DRAWINGS

The invention is now to be described as a non-limited example of the invention with reference to the attached drawings.

FIG. 1*a* shows a side view of a locking system comprising a locking device and a locking arrangement according to the invention, with the bolt in a first, projected state.

Figure 1B:
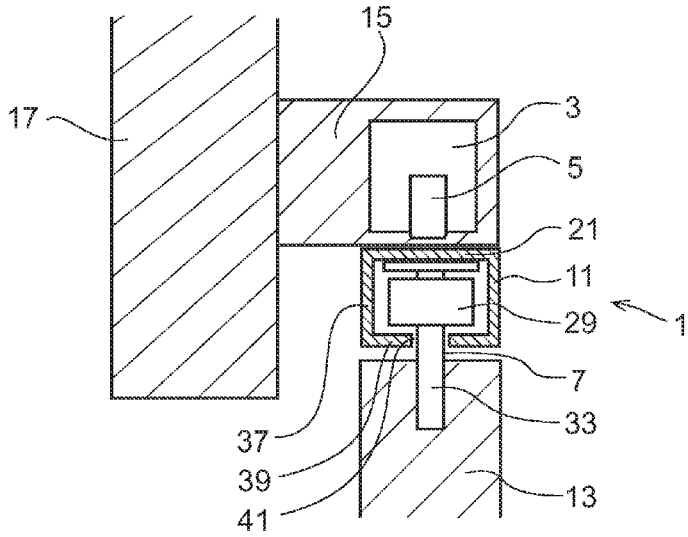

FIG. 1*b* shows a view from above of the locking system in FIG. 1*a*, with the bolt in a second, withdrawn state.

Figure 2A:
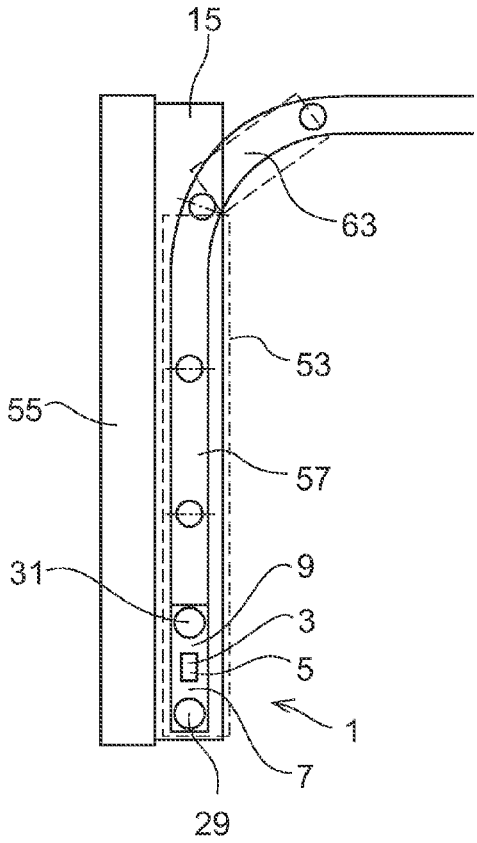

FIG. 2*a* shows a side view over a garage door in closed state.

Figure 2B:
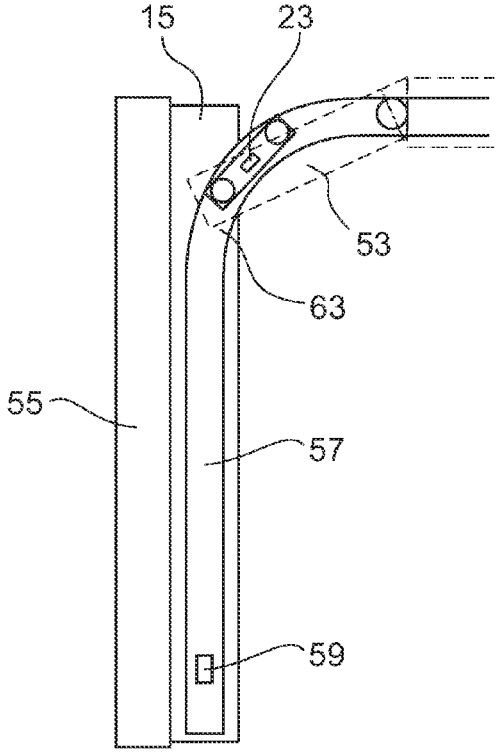

FIG. 2*b* shows a side view over a garage door in an open state.

DETAILED DESCRIPTION

In FIGS. 1*a* and 1*b* a locking system 1 according to one example of the invention is shown, which comprises a locking device 3 comprising a locking bolt 5, and a locking arrangement 7 comprising a locking member 9. The locking system 1 further comprises a railing 11 and a shutter element 13 arranged to slide along the railing 11.

The locking bolt 5 is movable between a first state, which is shown in FIG. 1*a* in which the locking bolt is adapted to engage with the locking member 9 in order to lock the shutter element 13 against movement along the railing 11, and a second state, which is shown in FIG. 1*b*, in which the locking bolt 5 is adapted to avoid engaging the locking member 9 and to allow movement of the shutter element 13. The locking member is in a corresponding manner shaped to allow the locking bolt 5 to, in the first state, engage with and lock the locking member 9, and thus the shutter element 13, against movement along the railing 11.

According to the invention the locking member 9 is adapted to slide inside the railing 11. The railing is further shaped to allow the locking bolt 5 to project into the railing 11, and the locking bolt 5 is correspondingly shaped to, in the first state, project into the railing 11 for engagement with the locking member 9 inside the railing 11. Thus the shutter element is locked against movement from inside the railing 11, which saves space.

In this example the locking system comprises an attachment element 15 adapted to connect the railing with a fixed wall 17, in this example an outer wall. The locking device 3 is adapted to be positioned inside the attachment element 15. Thus the locking device is positioned at a position, which previously has been unused, which saves space. The locking device 3 is further protected inside the attachment element 15. The locking device 3 is at the same time shaped for being positioned behind the railing 11, wherein the bolt 5 is shaped to project into the railing through a hole 19 in the back 21 of the railing 11.

The locking member 9 in turn comprises a hole 23 shaped to allow passage of the locking bolt 5 and thus engagement between the locking bolt 5 and the locking member 9. The locking bolt 5 further comprises an engagement surface 25 adapted to engage with and lock the locking member 9 from movement. The engagement surface 25 is angled relative to the length of the railing 11, in this example concave and continuously curved. Thus the locking member 9 is pressed towards the back 21 of the railing if the shutter element is pressed towards being opened when the locking bolt 5 is in the first state, by the locking member 9 being pressed towards the angled engagement surface 25 of the locking bolt 5, so that the force is directed towards the back. In another example the engagement surface may of course be angled in some other direction so that the locking member 9 is pressed towards some other side of the railing, or of the locking device itself.

The locking bolt further comprises an outside 27, which is angled so that the locking bolt 5 is pressed towards the second state when the locking member 9 is pressed towards the outside. In this example the outside 27 is convex and also continuously curved. When closing the shutter element 13 the locking member 9 is pressed towards the outside 27, wherein the locking bolt is displaced towards the second state and allows passage of, and thus closing of, the locking member 9 and the shutter element 13. The locking member 9 comprises in this example an inclining edge 35 adapted to be pressed towards the outside 27 of the bolt in order to, during closing, press the bolt 5 towards the second state. Thus the pressing in of the locking bolt 5 is improved even further.

In this example the locking member 9 comprises a first wheel 29 adapted to slide inside the railing 11. Thus the friction for the locking member 9 is decreased. It is further advantageous if the locking member 9 comprises one of the wheels usually present with the shutter element 13. In this example the locking member 9 comprises an elongated shutter plate 28, which also comprises said hole 23. Thus the strength of the locking system increases in comparison with if the bolt would engage with for example a wheel or a wheel axle directly. In this example the locking member 9 also comprises a second wheel 31 adapted to slide inside the railing 11. The wheels 29 and 31 are connected with the locking member 9 in one end of the locking member 9 each. Thus stability is achieved for the elongated shutter plate 28, since the locking device 9 is connected with the railing 11 in two points.

The locking member 9 is further connected with the shutter element 13 by a wheel axle 33, in this example the wheel axle belonging to the first wheel 29, which is provided in the part of the locking member 9 which is directed towards the end of the shutter element. The locking member 9 is further rotatably connected with the shutter element 13 by the wheel axle 33. In this example the shutter plate 28 is fixedly connected with the wheel axle 33, while the wheel axle 33 in turn is rotatably beared in the shutter element 13. Thus the durability increases. The first wheel 29 is in turn adapted to rotate freely on the wheel axle 33. The railing 11 is in this example a guiding-rail, wherein the railing 11 comprises a back 21, two sidewalls 37 and a front 39 provided with a groove 41 in order to allow passage of the wheel axle 33. Thus the wheels 29, 31 are locked in the railing 11.

In FIGS. 2*a* and 2*b* one example of a use of a locking system 1 according to the invention is shown. The locking system 1 thus comprises a shutter element 53 in the form of a garage door, an outer wall 55 and a railing 57 in the form of a guiding-rail. The railing 57 is curved for at least one portion 63 to allow displacement of the shutter element 53 up to the ceiling of the garage. The shutter element 53 is hinged in sections to allow passage past the curved portion 63.

The railing 57 is provided with a hole 59 adapted to allow passage of the locking bolt 5 from the backside of the railing and into the railing. Furthermore the hole 59 is positioned close to the end of the railing 57, as seen in the direction of a closing movement of the shutter element. The locking device 3 is correspondingly shaped to be positioned close to the end of the railing. Thus the shutter element will not be disturbed by the possibly projecting locking bolt 5 during movement of the shutter element along the railing 57, until at the end of or at the beginning of a closing or opening movement, respectively. In FIG. 2*a* the shutter element is shown in a closed position. Furthermore, due to that the locking member 9 is rotatable, the locking member 9, and the elongated shutter plate 28, does not risk to get stuck in the curved portion 63. In FIG. 2*b* the shutter element 53 is shown in an open position, in which the locking member 9 is rotated in the curved portion 63.

The invention is not limited to the embodiments shown but may be varied freely within the framework of the following claims.

The invention claimed is:

1. A locking in mechanism comprising the combination of (i) and (ii);

(i) a device (3) configured for locking a shutter element (13, 53) arranged to slide along a railing (11, 57), which locking device (3) comprises at least one locking bolt (5) movable between a first state, in which the locking bolt (5) is configured to engage with a locking member (9) of the shutter element (13, 53) to lock the shutter element (13, 53) against movement, and a second state, in which the locking bolt (5) is configured to avoid engagement with the locking member (9) and allow movement of the shutter element (13, 53), wherein the locking bolt (5) is shaped to project into the railing (11, 57) in the first state for engagement with the locking member (9) inside the railing (11, 57), and the bolt (5) is configured to cooperate engagingly with a shutter plate (28) of the locking member (9), the locking device (3) is shaped for placement behind the railing (11, 57) and inside an attachment element (15) configured to connect the railing (11, 57) with a wall (17), the locking bolt (5) is shaped to project into the railing (11, 67) through a hole (19, 59) in the back (21) of the railing (11, 57), and the locking bolt (5) has opposing curved surfaces (25, 27), both curving to a tip of the locking bolt (5), an engagement surface (25) being concavely and continuously curved and configured to engage with and lock the locking member (9) from movement, which engagement surface (25) is curved such that the locking member (9) is pressed towards a fixed side (21) of at least one of the railing (11, 57) and locking device (3) when the locking member (9) is pressed towards the locking bolt (5), and an opposing surface (27) being convexly and continuously curved such that the bolt (5) is pressed towards the second state and into the locking device (3) when pressed by the locking member (9), and (ii) a slide (7) configured to be connected with and allow locking of the shutter element (13, 53) and arranged to slide along the railing (11, 57), which slide (7) comprises the at least one locking member (9) shaped to allow the locking bolt (5) to, in the first state, engage with and lock the locking member (9), and thus the shutter element (13, 53), against movement, wherein the locking member (9) is configured to slide inside the railing (11, 57) and comprises the shutter plate (28) comprising a hole (23) to allow passage of the locking bolt (5) through the hole (23) for engagingly cooperating with the locking bolt (5) inside the railing (11, 57), and the hole (23) is configured to face towards a backside (21) of the railing (11, 57), which backside (21) is configured for being attached against an attachment element (15) or a wall (17).

2. A locking combination (3, 7) according to claim 1, wherein the locking device (3) is configured to be positioned inside the attachment element (15) configured to connect the railing (11, 57) with the wall element (17).

3. A locking combination (3, 7) according to claim 1, the locking member (9) comprises a guiding element (29) configured to slide in the railing (11, 57).

4. A locking combination (3, according to claim 1, wherein the locking member (9) comprises a wheel axle (33) configured to be connected with the shutter element (13, 53).

5. A locking combination (3, 7) according to claim 3, wherein the locking member (9) further comprises an additional guiding element (31) configured to slide along the railing (11, 57).

6. A locking combination (3, 7) according to claim 1, wherein the locking member (9) is configured to be rotatably connected with the shutter element (13, 53).

7. A locking combination (3, 7) according to claim 1, wherein the shutter plate (28) comprises an inclining edge (35) configured to be pressed against an outside (27) of the locking bolt (5) to press the holt (5) towards the second state in which the locking holt (5) avoids engagement with the locking member (9) and allows movement of the shutter element (13, 53).

8. A locking combination (3,7) according to claim 5, wherein both guiding elements (29,31) are wheels.

9. A locking combination (3, 7) according to claim 1, wherein the slide (7) comprises a guiding element (29) configured to slide in the railing (11, 57), and a wheel axle (33) on which the guiding element (29) and shutter plate (28) are mounted and configured for connecting with the shutter element (13, 53).

* * * * *